US011517909B2

(12) United States Patent
Mayer et al.

(10) Patent No.: US 11,517,909 B2
(45) Date of Patent: Dec. 6, 2022

(54) STRIKING TOOL AND ROTOR FITTED THEREWITH FOR A MACHINE FOR CRUSHING METAL OBJECTS OR STONE MATERIALS

(71) Applicant: Stahlwerke Bochum GmbH, Bochum (DE)

(72) Inventors: Bruno Mayer, Bochum (DE); Stephan O. Mayer, Duisburg (DE)

(73) Assignee: Stahlwerke Bochum GmbH, Bochum (DE)

( * ) Notice: Subject to any disclaimer, the term of this patent is extended or adjusted under 35 U.S.C. 154(b) by 0 days.

(21) Appl. No.: 17/048,204

(22) PCT Filed: Apr. 18, 2018

(86) PCT No.: PCT/EP2018/059909

§ 371 (c)(1),
(2) Date: Oct. 16, 2020

(87) PCT Pub. No.: WO2019/201436

PCT Pub. Date: Oct. 24, 2019

(65) Prior Publication Data

US 2021/0205818 A1 Jul. 8, 2021

(51) Int. Cl.
*B02C 13/28* (2006.01)

(52) U.S. Cl.
CPC ..... *B02C 13/28* (2013.01)

(58) Field of Classification Search
CPC ..... B02C 13/28; B02C 13/128
See application file for complete search history.

(56) References Cited

U.S. PATENT DOCUMENTS 1,761,083 A * 6/1930 Liggett ..... B02C 13/28 241/32
2,982,486 A * 5/1961 Ehmann ..... B02C 13/28 241/197

(Continued)

FOREIGN PATENT DOCUMENTS

| | | |
|---|---|---|
| CZ | 2795 U | 3/1995 |
| EP | 1047499 B1 | 4/2003 |
| WO | 9705951 A1 | 2/1997 |

OTHER PUBLICATIONS

"Stahlwerke Bochum—Hochverschleißfeste Gußteile", 2012, pp. 1-9. (Relevant for reasons stated in Specification).

*Primary Examiner* — Faye Francis
(74) *Attorney, Agent, or Firm* — The Webb Law Firm

(57) ABSTRACT

A striking tool for crushing metal objects or stone materials, manufactured from an iron-based material and including a bearing section, into which a bearing opening provided for the freely swinging mounting of the striking tool on a metallic shaft is formed with an inner circumferential surface surrounding the bearing opening, and including a striking section, which is exposed to a striking load by contact with the material to be crushed, and a rotor for a machine for crushing metal objects or stone materials, including at least one metallic shaft, on which at least one formed striking tool is mounted with its bearing opening, with there being metallic frictional contact between the outer circumferential surface of the shaft and the inner circumferential surface of the bearing opening of the striking tool. The striking tool allows, the danger of excess wear in the region of its bearing opening to be minimized.

13 Claims, 3 Drawing Sheets

(56) References Cited

U.S. PATENT DOCUMENTS

| | | | | | |
|---|---|---|---|---|---|
| 3,738,586 | A * | 6/1973 | Fabert, Jr. | B02C 13/28 | 241/195 |
| 4,046,327 | A * | 9/1977 | Cranor | B02C 13/28 | 241/197 |
| 4,142,687 | A * | 3/1979 | Potwin | B02C 13/28 | 241/194 |
| 4,310,125 | A | 1/1982 | Novotny | | |
| 5,598,981 | A * | 2/1997 | Hellmich | B02C 13/28 | 241/189.1 |
| 6,971,598 | B2 * | 12/2005 | Schillinger | B02C 13/28 | 241/194 |
| 7,140,569 | B2 * | 11/2006 | Young | B02C 13/04 | 241/195 |
| 7,419,109 | B1 * | 9/2008 | Ronfeldt | B02C 13/28 | 241/189.1 |
| 8,104,177 | B2 * | 1/2012 | Plumb | B02C 13/28 | 29/898.07 |
| 10,413,908 | B2 * | 9/2019 | Plumb | B02C 13/28 | |
| 2004/0017955 | A1 * | 1/2004 | Schillinger | B02C 13/28 | 384/420 |
| 2009/0224090 | A1 * | 9/2009 | Young | B02C 13/04 | 241/195 |
| 2009/0250539 | A1 * | 10/2009 | Stelk | B02C 13/28 | 241/197 |
| 2012/0037737 | A1 * | 2/2012 | Plumb | B02C 13/28 | 241/194 |
| 2014/0151475 | A1 * | 6/2014 | Graf | B02C 13/04 | 241/27 |
| 2017/0291175 | A1 * | 10/2017 | Plumb | B02C 13/28 | |
| 2017/0368552 | A1 * | 12/2017 | Plumb | F16C 11/0685 | |

* cited by examiner

STRIKING TOOL AND ROTOR FITTED THEREWITH FOR A MACHINE FOR CRUSHING METAL OBJECTS OR STONE MATERIALS

CROSS-REFERENCE TO RELATED APPLICATION

This application is the United States national phase of International Application No. PCT/EP2018/059909 filed Apr. 18, 2018, the disclosure of which is hereby incorporated by reference in its entirety.

BACKGROUND OF THE INVENTION

Field of the Invention

The invention relates to a striking tool for crushing metal objects or stone materials.

Description of Related Art

Such impact tools are also called striking hammers and are used in machines to crush metal scrap, such as bodies of vehicles intended for scrap, or demolition or construction waste.

The striking tools, which are usually cast in one piece from an iron-based material or, alternatively, manufactured by forging or flame cutting a correspondingly formed primary product or as a weld construction, comprise a bearing section, into which a bearing opening is formed with an inner circumferential surface surrounding the bearing opening, and a striking section, which is exposed during use to a striking load by contact with the material to be crushed. During use a metallic shaft is pushed through the opening, the striking tool being mounted on the shaft in a swinging manner such that there is metallic frictional contact between the outer circumferential surface of the shaft and the inner circumferential surface of the bearing opening of the striking tool.

Examples of such striking tools are described in WO 97/05951 A1 and the brochure "Stahlwerke Bochum—Hochverschleißfeste Gußteile", from 2012, published by the applicant and available for download following the URL http://stahlwerkebochum.com/wp-content/uploads/2015/07/swb_image_prospekt_d.pdf.

An example of a rotor for a crushing machine which can be fitted with the striking tools of the type considered here, is represented in EP 1 047 499 B1.

Such rotors rotate during use around an axis of rotation and have on their circumference a plurality of shafts distributed at equal angular distances around the axis of rotation and extending axially parallel to the axis of rotation, on which a larger number of striking hammers are arranged freely swinging and spaced apart from one another. In its circumferential regions between the striking hammers, the rotor is generally equipped with so-called "protective caps" which, like the striking hammers, can generally be manufactured from a highly wear-resistant steel, largely using casting technology, but alternatively also by forging, flame cutting or as weld construction. The protective caps arranged immediately adjacent to the striking hammers are in this case mounted spaced apart from the respective striking hammer such that, on the one hand, the striking hammer can freely perform its swing movement, but on the other hand the gap, which must necessarily be present between the respective protective cap and the assigned striking hammer, in order to enable its swing movement, is as narrow as possible in order to prevent, during operation, the ingress of metal or stone parts in the gap in question and prevent blocking of the hammer due to material sitting in the gap.

The centrifugal forces acting as a function of the respective revolution speeds in the case of the striking tools of the above-mentioned type mounted so as to rotate vertically or horizontally are high and lead to strong dynamic loads in the bearing opening, with the inner circumferential surface of the bearing opening being affected in particular thereby, which is exposed to direct metallic frictional contact with the shaft of the rotor. Dynamic load portions lead here to high tension spikes.

Practical experience shows that with progressive useful life and associated increase in the load change, to which the striking tool is exposed, there is deformation of the bearing opening. Thus, it is not only the bearing opening that is expanded in the radial direction, but rolling effects also result by means of which material of the striking tool surrounding the bearing opening is displaced in the longitudinal direction of the bearing opening. Thickened portions, so-called "projecting flanges" are thereby formed on the front end-side mouths of the bearing opening. They can rise so much that the width of the bearing section of the striking tool increases beyond its original width in its region adjoining the bearing opening.

This appearance of wear can be become so much that the gap between the striking tool and the protective caps each positioned laterally next to it is closed by material displaced from the bearing eye and the swing movement of the striking tool is blocked. Even if this case does not occur, as a result of the lateral material displacement occurring in practical use, increased wear of the shaft occurs, on which the striking tools are mounted, and in the region of the transitions of the bearing opening to the respective front end of the striking tool or at the assigned side surfaces of the adjacent protective caps on which the material displaced from the bearing opening rubs.

Against the background of the previously explained prior art, the object therefore emerges to provide a striking tool, in which, using simple means, the danger of excessive wear in the region of its bearing opening is minimized even under high loads.

Moreover, a rotor should be provided for a machine to crush metal or stone materials, in which, using simple means, an optimally long useful life of the striking tools mounted on it in a swinging manner is achieved.

SUMMARY OF THE INVENTION

A striking tool, according to the invention, achieves the above object.

A rotor solving the object mentioned above for a machine to crush metal or stone materials, in particular scrap, such as car bodies to be scraped, or stone debris originating from building construction or demolition is accordingly equipped with a striking tool according to the invention.

Advantageous embodiments of the invention are defined herein and, like the general concept of the invention, are explained in detail in the following.

A striking tool according to the invention for crushing metal objects or stone materials is accordingly manufactured in line with the prior art explained at the outset from an iron-based material and comprises a bearing section, into which a bearing opening provided for the freely swinging mounting of the striking tool on a metallic shaft is formed with an inner circumferential surface surrounding the bearing opening and a striking section which is exposed during use to a striking load by contact with the material to be crushed. According to the invention, a recess is formed at least into a section of the inner circumferential surface of the bearing eye which is provided to receive metallic material of the striking tool laterally adjoining the recess and displaced during use.

The at least one recess, which is formed according to the invention into the inner circumferential surface surrounding the bearing opening, provides space in the region of the inner circumferential surface itself, into which the material of the striking hammer escaping as a result of the pressure forces acting during practical use on the inner circumferential surface can escape. In this way, on the one hand, material, which surrounds the bearing opening, is prevented from being laterally displaced from the bearing opening and leading there to a thickening of the striking hammer and therefore to a narrowing of the movement gap between the front end of the striking hammer in question and the assigned side of the adjacent protective cap. Otherwise, the pressure tensions in the region of the inner circumferential surface of the striking tool delimiting the bearing opening are delimited such that the material displacement is reduced and the danger of crack formation or other damage, such as pieces of material breaking off and the like, is reduced.

The design of the inner circumferential surface of the bearing opening according to the invention therefore allows the useful life of a striking tool for crushing materials, which is exposed during practical use to the highest loads, to be effectively extended. The geometry of the bearing opening is stabilized over the useful life of the striking tool through the structuring of the inner circumferential surface achieved by means of the recess provided according to the invention. Rolling of the material is largely avoided and the surface tensions are reduced with the result that crack-causing factors and factors possibly leading to damage of the striking tools are minimized.

In this case, the recess provided according to the invention can be introduced into the inner circumferential surface in a particularly easy manner in terms of manufacturing technology. The recess can thus already be introduced into the inner circumferential surface during casting of the striking tool by means of a suitably formed casting core representing the bearing eye. However, it can also be produced by other production processes, such as for example by an electroerosion or mechanical, in particular machining, processes.

In most practical application cases, a striking tool according to the invention swings around the shaft, on which it is mounted, in each case only over a pivot range which is smaller than 360°. In these cases, it is generally sufficient when the recess provided according to the invention is limited to the region of the inner circumferential surface in which there results high pressure tensions as a result of the centrifugal forces acting on the striking tool during use. This allows the respectively less burdened region of the bearing opening to be designed differently, for example in the form of an extension of the bearing opening extending in the direction of the striking section such that the bearing section of the striking tool obtains elongation properties, which protect it from the occurrence of cracks and breaks, not only due to its material properties, but also due to its forming.

The shape and profile of the recess provided according to the invention must be formed such that the material laterally displaced during use in the region of the inner circumferential surface of the bearing eye is received as completely as possible by the recesses.

To this end, it may be expedient to form into the section, provided with the recess, of the inner circumferential surface of the bearing opening through the recess a surface structure in which at least one circumferential surface region of the inner circumferential surface is separated by the recess from an adjacent circumferential surface region of the inner circumferential surface. By way of the division of the inner circumferential surface carried out in this way, the volume present in the regions respectively separated from one another and available for displacement is reduced such that the potentially displaced material quantities are also reduced.

The simplest way of dividing in this way is a recess circulating around the inner circumferential surface. To this end, the recess can for example be formed in the form of a ring groove circulating around the longitudinal axis of the bearing opening in a circular manner.

The recess can in each case have the design of a channel, and it goes without saying that irrespective of which design is provided for the recess, the transitions, corners and edges of the recess are each designed, in particular rounded, such that the danger of a notch effect otherwise occurring there is avoided.

In order to achieve several divisions of the inner circumferential surface into two or more circumferential surface regions separated from one another, two or more recesses can be formed into the inner circumferential surface of the bearing eye distributed in the longitudinal direction of the bearing opening.

Another example of a recess, which structures the inner circumferential surface such that between two adjacent sections of the recess in each case one circumferential surface region of delimited elongation is present, is a recess which is formed into the inner circumferential surface circulating around the bearing opening in a spiral manner.

Similarly, the recess in the inner circumferential surface of the bearing opening can form a structure, in which at least one circumferential surface region of the inner circumferential surface is surrounded in the longitudinal and circumferential direction of the inner circumferential surface completely by the recess. To this end, the recess can be formed such that the circumferential surface region surrounded by the recess is elliptical, circular, square or rhombus shaped. Of course, the recess can in this case be formed such that two or more circumferential regions of the inner circumferential surface are separated from one another.

Such a structure can also be formed by a plurality of channel-shaped recesses crossing one another which have different depths or widths.

In particular, in terms of the uniformity of the loading, to which the individual circumferential sections separated from one another by the recess in this configuration are exposed during use, it may be advantageous when the circumferential sections in question are distributed uniformly over the inner circumferential surface of the bearing opening, a regular structure thus being formed into the inner circumferential surface by the recess, in which circumferential surface sections separated from one another are present distributed in a regular arrangement on the inner circumferential surface.

As already mentioned, design and elongation of the recess provided according to the invention on the inner circumferential surface of the bearing opening of the striking tool according to the invention are to be selected such that it can as completely as possible receive the material potentially displaced during use and surrounding the bearing eye. It has proven itself to this end when the depth of the recess measured in the radial direction proceeding from the inner circumferential surface is carried out taking into account the hardness which is present in a near-surface layer adjoining the inner circumferential surface of the bearing opening when starting to use the striking tool or it is set there during the course of use. In this way, the inflow of the properties of the material, of which a striking tool consists, and the heat treatment, which the striking tool undergoes during its manufacture, can be taken into account in order to adapt its mechanical properties optimally to the loads occurring during use.

Thus, a striking tool according to the invention can consist of a steel cast material, in which as a result of a near-surface cold deformation, such as occurs with the use of a striking tool according to the invention in the contact region between inner circumferential surface of the bearing opening and outer circumferential surface of the shaft, on which the striking tool swings, there is a solidifying and associated increase in hardness. Similarly, as a result of a heat treatment, which the striking tool undergoes during its manufacture in order to set a maximum hardness in the region of its striking section and an optimized toughness in the region of its bearing section, there is a decarburization and associated decrease in hardness in a surface layer adjoining the inner circumferential surface of the bearing opening.

In particular in the latter case, it is advantageous when the depth of the recess measured in the radial direction proceeding from the inner circumferential surface into the material of the striking tool is at least the same thickness of a surface layer adjoining the inner circumferential surface, whose hardness is less than the hardness of a core layer of the striking tool adjoining the surface layer and delimited by the surface layer with respect to the bearing opening. In practice, recesses, which are for example 2 to 30 mm in depth, are suitable here.

In order to assure a sufficient load-bearing capacity of the inner circumferential surface of the bearing opening of a striking tool according to the invention in spite of the recess provided according to the invention, the recess should occupy at most 50% of the inner circumferential surface of the bearing opening, and the recess should advantageously extend over at least 25%, in particular over at least 30% or at least one third of the inner circumferential surface in order to provide a sufficiently large receiving space for the material of the striking tool displaced during use. The "inner circumferential surface" provided with a recess is used here for this measurement as the reference value for the ° A) information. This is for example in the case of a bearing opening with a circular clear diameter the same as a hollow cylindrical surface, whose diameter is the same as the clear width of the bearing opening.

If a plurality of recesses independent of one another are provided, they can have different widths and depths. The recesses can be arranged here in relation to the longitudinal axis of the bearing opening (when projecting into a drawing plane) at an angle of 10° to 80°.

Typical steel materials, from which striking tools designed according to the invention are manufactured, are quenched and tempered steels which solidify martensitically and are used already today for this purpose with carbon contents of 0.1 to 0.70% by weight. Similarly, striking tools according to the invention can be manufactured from austenitically solidifying steels with manganese contents of 7 to 30% by weight. These types of steel known under the name "Hadfield steels" have been proven in practice for manufacturing striking tools of the type in question here for many years. An example of such a Hadfield steel is the steel commercially available under the standard designation X120Mn12 and the material number 1.3401. Hadfield steels have a good wear resistance due to their high cold hardening ability precisely under impacting load.

Furthermore, striking tools according to the invention can be cast from iron cast materials known for this purpose, for example from so-called "white cast iron", which has chromium contents of up to 29% by weight.

As an alternative to the aforementioned cast manufacture of striking tools according to the invention made of steel or iron cast materials, it is also possible to manufacture such striking tools by forging or by flame cutting from a correspondingly formed primary product or as a weld construction from pre-fabricated parts.

BRIEF DESCRIPTION OF THE DRAWINGS

The invention is explained in more detail in the following with reference to a drawing representing an exemplary embodiment. The figures show schematically and not to scale.

DESCRIPTION OF THE INVENTION

Figure 1:
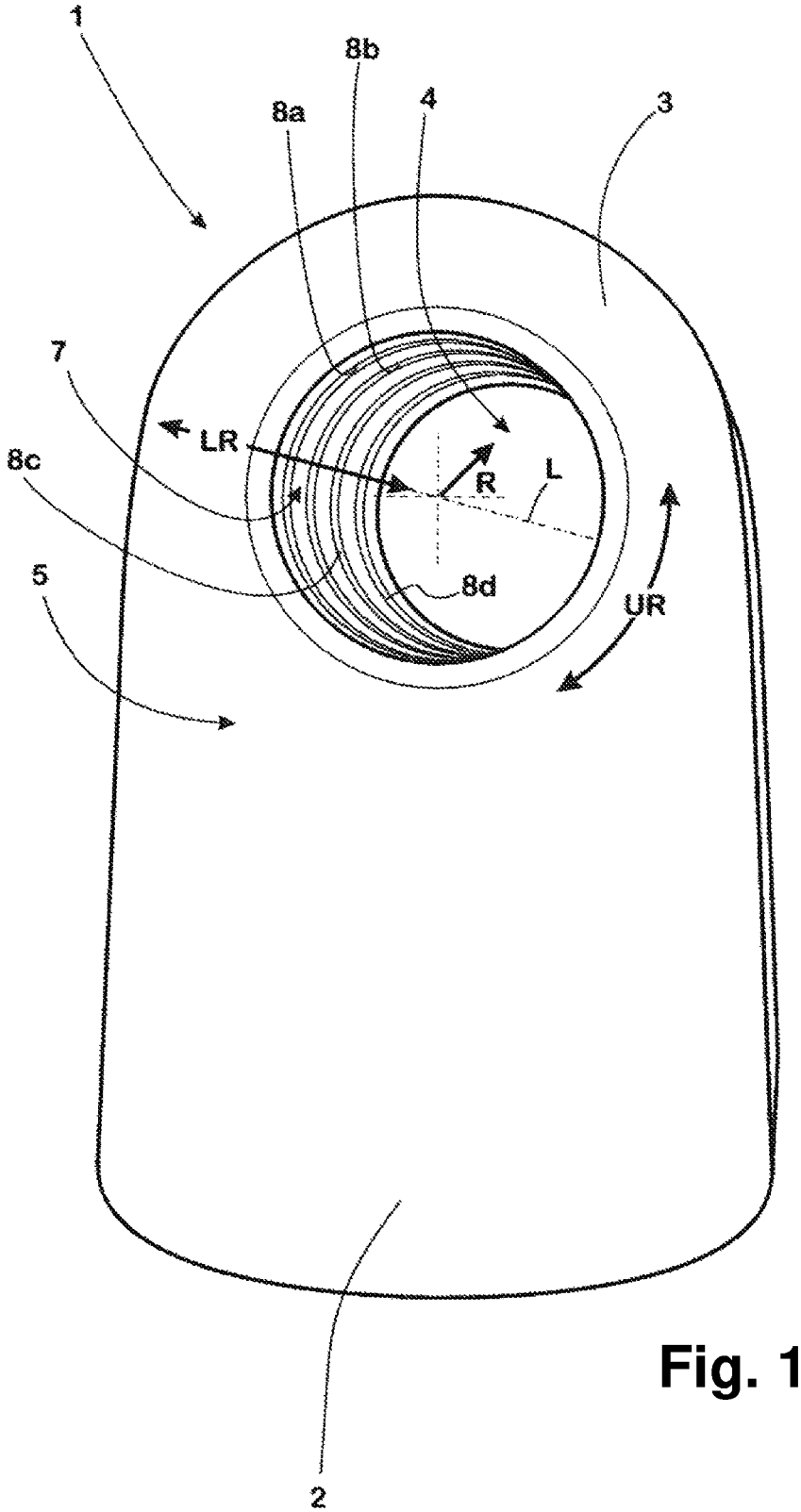
FIG. 1 a striking tool in perspective view.

The striking tool 1 serves as the striking hammer for crushing metal scrap, such as vehicle bodies, mineral raw materials or mineral waste, such as construction debris, overburden or the like.

To this end, the striking tool is mounted on a conventional rotor not shown here in the manner so as to swing on a shaft of the rotor also not shown here. The manner of the swinging mounting of a striking tool, which belongs to the same generic group as a striking tool according to the invention, is for example described in EP 1 047 499 B1.

In order to fulfil its purpose, the striking tool 1 cast in a conventional manner in one piece for example from a Hadfield steel has a striking section 2 hardened by a suitable heat treatment in a manner also known per se, which comes into contact with the material to be crushed during practical use and as a result is exposed to extreme striking loads, and has a bearing section 3, which is heat treated in a similarly known manner such that it has a sufficient toughness and elongation properties, by means of which it is capable of absorbing the dynamic loads acting on the striking tool 1 during use.

A centrally arranged bearing opening 4 is formed into the bearing section 3 which extends between the front ends 5, 6 of the striking tool 1 over its width B. The central longitudinal axis L of the bearing opening 4 defines the swing axis around which the striking tool 1 swings during use around the shaft of the rotor generally also consisting of a steel material. A metallic frictional contact exists between the outer circumferential surface of the shaft of the rotor and the inner circumferential surface 7 which surrounds the bearing opening 4 of the striking tool 1. In the new state, the shape of the inner circumferential surface 7 corresponds to the shape of the hollow cylindrical surface, whose diameter is the same as the clear width dW of the bearing opening 4.

Figure 2:
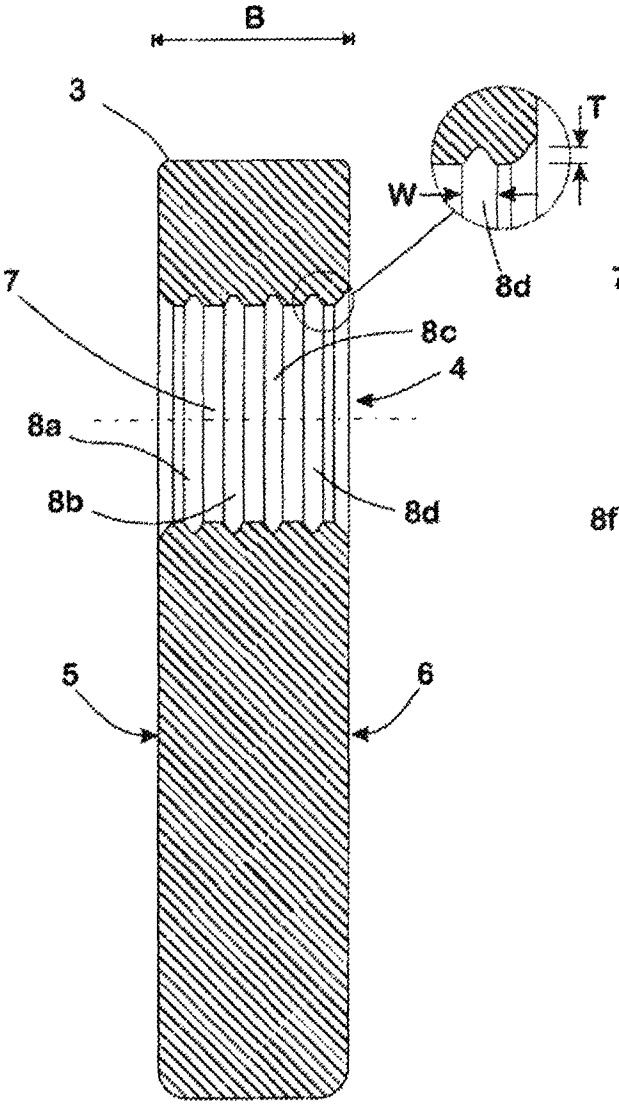
FIG. 2 the striking tool according to FIG. 1 in a longitudinal section.

In the case of the configuration of the striking tool 1 shown in FIGS. 1 and 2, four recesses 8*a* to 8*d* each formed in the manner of a channel-shaped ring groove and circulating around the central longitudinal axis L of the bearing opening 4 are formed into the inner circumferential surface 7 distributed at regular distances over the width B of the striking tool 1. The circular sections of the inner circumferential surface each present between the recesses 8*a* to 8*d* are separated from one another by the recesses 8*a* to 8*d*.

The depth T measured in the radial direction R and the clear width W of the inner circumferential-side opening surface of the recesses 8*a* to 8*d* measured at the border to the inner circumferential surface 7 are dimensioned, taking into account the groove shape of the recesses 8*a* to 8*d*, such that, on the one hand, sufficient space is present in the region of the recesses 8*a* to 8*d* to receive material which is displaced during use from the sections, which each laterally adjoin the recesses 8*a* to 8*d*, of the material of the striking tool 1 surrounding the bearing opening 4. Otherwise, the clear width W of the recesses 8*a* to 8*d* is dimensioned such that the inner circumferential-side openings of the recesses 8*a* to 8*d* occupy for example roughly 40% of the entire circumferential surface 7, i.e. of the inner circumferential surface of a hollow cylinder, whose diameter corresponds to the clear width dW of the bearing opening 4.

Figure 3:
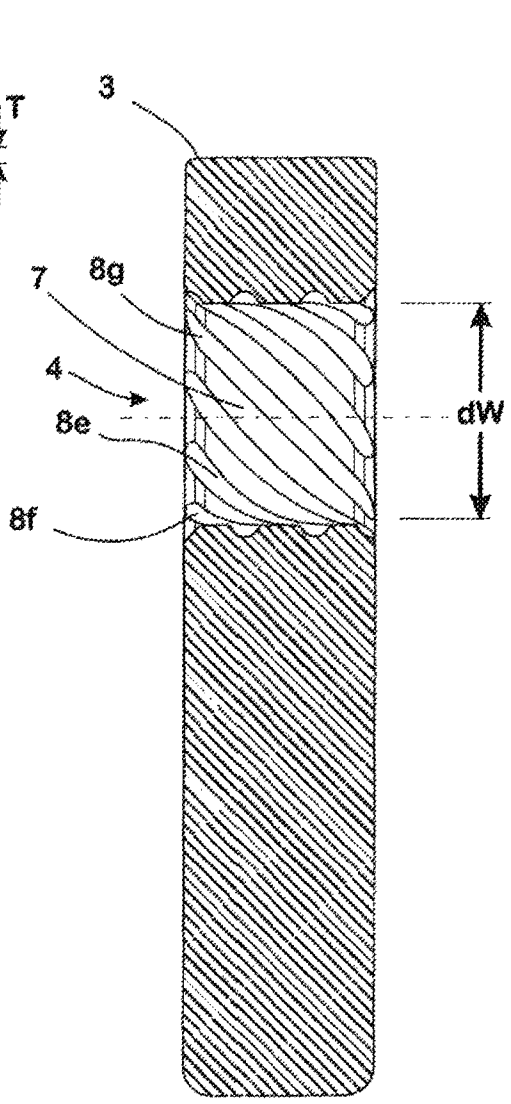

In the case of the embodiment represented in FIG. 3, a plurality of channel-shaped recesses 8*e* to 8*g* arranged distributed at regular distances around the circumference of the bearing opening 4 are also present, which in the case of the projection into the drawing plane carried out in FIG. 2, extend, aligned in relation to the central longitudinal axis L of the bearing opening at an angle of 45°, in a spiral manner in the longitudinal LR and circumferential direction UR of the bearing opening 4.

Figure 4:
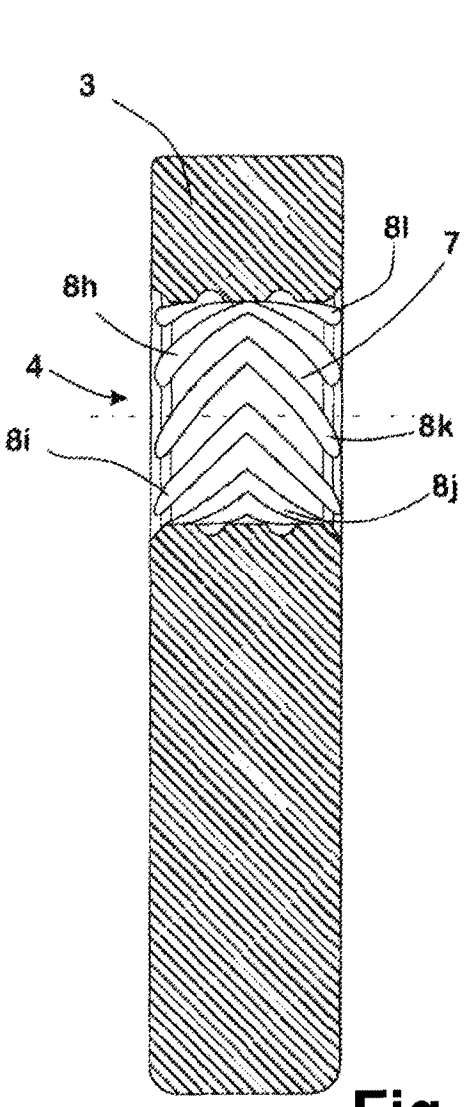
FIG. 3-6 configurations of the striking tool in a longitudinal sectional representation corresponding to FIG. 2.

In the case of the configuration represented in FIG. 4, the inner circumferential surface 7 is also profiled by channel-shaped recesses 8*h* to 8*l*, which, in the projection into the drawing plane, have sections tapering in a V shape, which are equilateral and angled with respect to the longitudinal axis L by 45°.

Figure 5:
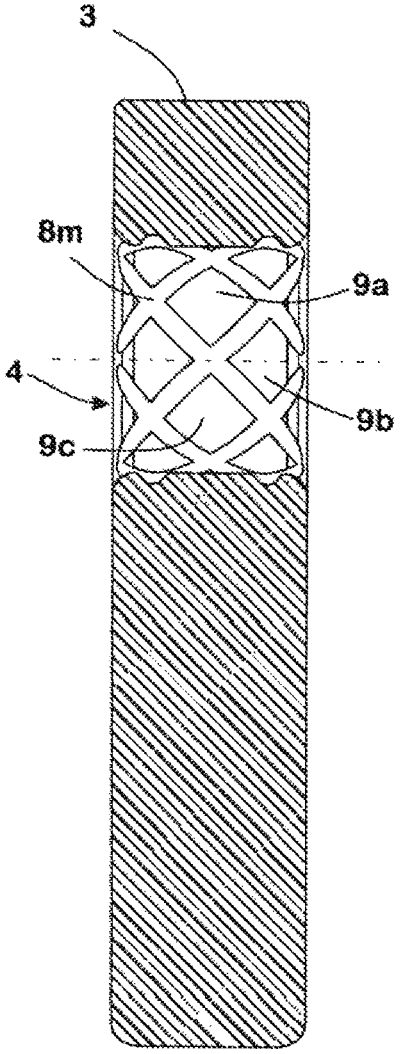
Figure 6:
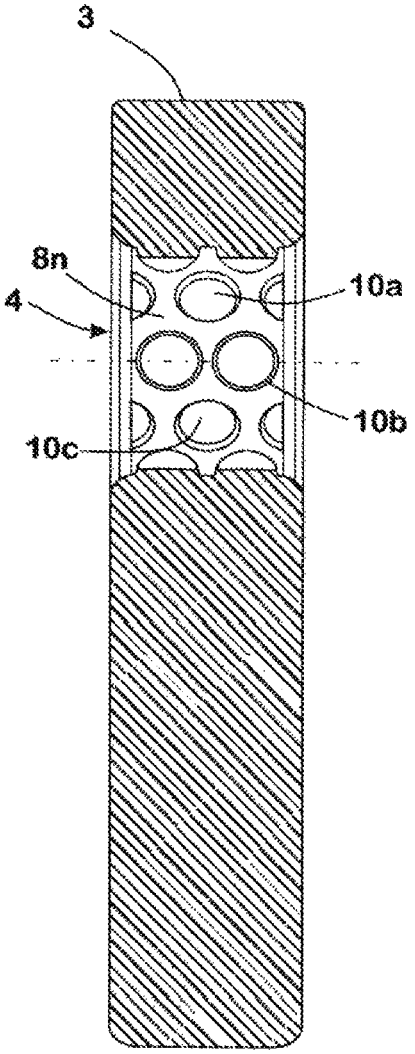

In the case of the variants represented in FIGS. 5 and 6, the recesses 8*m* and 8*n* form a connecting, pattern-like structure, in which rhombus (FIG. 5) or circular (FIG. 6) shaped circumferential surface sections 9*a* to 9*c*; 10*a* to 10*c* are surrounded in the longitudinal and circumferential direction on all sides by the respective recess 8*m*, 8*n* such that respectively adjacent circumferential surface sections 9*a* to 9*c*; 10*a* to 10*c* are each separated from one another by a section of the recess 8*m*, 8*n* in question. Such structuring of the inner circumferential surface 7 through the recesses 8*m*, 8*n* has the advantage that material extensions in the circumferential and longitudinal direction of the bearing opening 4 can be reliably received by the recesses 8*m*, 8*n*.

REFERENCE NUMERALS

1 Striking tool
2 Striking section
3 Bearing section
4 Bearing opening
5,6 Front ends of the striking tool 1
7 Inner circumferential surface of the bearing opening 4
8*a*-8*n* Recesses into the inner circumferential surface 7
9*a*-9*c* Circumferential surface sections
10*a*-10*c* Circumferential surface sections
B Width of the striking tool 1
dW Clear width dW of the bearing opening 4
L Central longitudinal axis of the bearing opening 4
LR Longitudinal direction
R radial direction
T depth of the recesses 8*a* to 8*n*
UR circumferential direction
W clear width of the inner circumferential-side opening surface of the recesses 8*a* to 8*n*

The invention claimed is:

1. A striking tool for crushing metal objects or stone materials, manufactured from an iron-based material and comprising:

a bearing section, into which a bearing opening with an inner circumferential surface surrounding the bearing opening is formed, wherein the bearing opening is provided for mounting of the striking tool on a shaft in a freely swinging manner; and comprising a striking section, which is configured to be exposed to a striking load by contact with the material to be crushed, wherein at least one recess is channel-shaped and formed into a section of the inner circumferential surface of the bearing opening; and wherein the at least one recess circulates in a spiral manner along the inner circumferential surface and is formed into a section of the inner circumferential surface such that between two adjacent sections of the at least one recess in each case a circumferential surface region of the inner circumferential surface is present.

2. The striking tool according to claim 1, wherein the at least one recess is provided at least in one section of the inner circumferential surface of the bearing opening, which is loaded with pressure when the striking tool is mounted on the metallic shaft of a rotating rotor.

3. The striking tool according to claim 1, wherein in the section of the inner circumferential surface of the bearing opening provided with the at least one recess, a surface structure is formed through the at least one recess in which at least one circumferential surface region of the inner circumferential surface is separated by the at least one recess from an adjacent circumferential surface region of the inner circumferential surface.

4. The striking tool according to claim 1, wherein the at least one recess circulates around the longitudinal axis of the bearing opening.

5. The striking tool according to claim 1, wherein the at least one recess circulates around the bearing opening in the manner of a ring groove.

6. The striking tool according to claim 1, wherein the circumferential surface region surrounded by the at least one recess is elliptical, circular, square or rhombus-shaped.

7. The striking tool according to claim 1, wherein the striking tool comprises a surface layer adjoining the inner circumferential surface and a core layer adjoining the surface layer and delimited by the surface layer from the bearing opening:

wherein the hardness of the surface layer is less than the hardness of the core layer;

wherein a depth (T) of the recess measured in a radial direction (R) proceeding from the inner circumferential surface of the striking tool is at least equal to a thickness of the surface layer.

8. The striking tool according to claim 7, wherein the depth (T) of the at least one recess is 2 to 30 mm.

9. The striking tool according to claim 1, wherein the at least one recess occupies 25 to 50% of the inner circumferential surface of the bearing opening.

10. The striking tool according to claim 1, wherein the striking tool consists of an iron or steel cast material.

11. A rotor for a machine for crushing metal objects or stone materials, comprising at least one metallic shaft, on which at least one striking tool formed according to claim 1 is mounted with the bearing opening, wherein there is metallic frictional contact between the outer circumferential surface of the shaft and the inner circumferential surface of the bearing opening of the striking tool.

12. A striking tool for crushing metal objects or stone materials, manufactured from an iron-based material and comprising:

a bearing section, into which a bearing opening with an inner circumferential surface surrounding the bearing opening is formed, wherein the bearing opening is provided for mounting of the striking tool on a shaft in a freely swinging manner; and comprising a striking section, which is configured to be exposed to a striking load by contact with the material to be crushed, wherein at least one recess is formed into a section of the inner circumferential surface of the bearing opening; and wherein the at least one recess completely surrounds at least one circumferential surface region of the inner circumferential surface in the longitudinal (LR) and circumferential direction (UR) of the inner circumferential surface; and wherein the at least one circumferential surface region surrounded by the at least one recess is elliptical, circular, square, or rhombus-shaped.

13. A striking tool for crushing metal objects or stone materials, manufactured from an iron-based material and comprising:

a bearing section, into which a bearing opening with an inner circumferential surface surrounding the bearing opening is formed, wherein the bearing opening is provided for mounting of the striking tool on a shaft in a freely swinging manner; and comprising a striking section, which is configured to be exposed to a striking load by contact with the material to be crushed, wherein at least one recess is channel-shaped and formed into a section of the inner circumferential surface of the bearing opening; and wherein two or more recesses are formed into the inner circumferential surface of the bearing opening distributed in the longitudinal direction (LR) of the bearing opening, the recesses being separated from one another by a section of the inner circumferential surface.

* * * * *